US007756449B2

(12) United States Patent
Belinkov et al.

(10) Patent No.: US 7,756,449 B2
(45) Date of Patent: Jul. 13, 2010

(54) ELECTROPHOTOGRAPHIC PRINTING APPARATUS AND METHODS IN WHICH CARRIER MEDIUM IS EXTRACTED FROM UNUSED INK

(75) Inventors: Haim Belinkov, Reshon le zion (IL); Eyal Peleg, Zoran (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 268 days.

(21) Appl. No.: 11/829,746

(22) Filed: Jul. 27, 2007

(65) Prior Publication Data

US 2009/0028610 A1 Jan. 29, 2009

(51) Int. Cl.
*G03G 15/10* (2006.01)

(52) U.S. Cl. ..... 399/249

(58) Field of Classification Search ..... 399/241, 399/249, 259

See application file for complete search history.

(56) References Cited

U.S. PATENT DOCUMENTS 3,650,196 A * 3/1972 Hosoe et al. ..... 399/30
5,463,453 A * 10/1995 Kurotori et al. ..... 399/249
5,574,548 A * 11/1996 Iino et al. ..... 399/240
5,933,689 A * 8/1999 Kim ..... 399/233

* cited by examiner

*Primary Examiner*—David M Gray
*Assistant Examiner*—Andrew V Do

(57) ABSTRACT

An electrophotographic printing apparatus includes an image-forming member having a surface on which a latent electrostatic image can be formed and a developer for depositing a layer of ink onto the surface of the image-forming member. The ink includes charged ink particles and a carrier medium. A supply conduit is connectable to an ink tank for supplying ink to the developer. An exit conduit is connectable to the ink tank for delivering unused ink from the developer to the ink tank. The supply conduit, the developer and the exit conduit define a flow path. A separator is operable to separate the carrier medium from the ink particles. The separator is connectable to the flow path to receive unused ink and to reintroduce carrier medium extracted from the unused ink to the flow path.

18 Claims, 3 Drawing Sheets

ELECTROPHOTOGRAPHIC PRINTING APPARATUS AND METHODS IN WHICH CARRIER MEDIUM IS EXTRACTED FROM UNUSED INK

This invention relates to improvements in or relating to electrophotographic printing and, in particular, but not exclusively, to the cleaning of ink from components of electrophotographic printing apparatus, such as a laser printer or electrophotographic press.

The cleaning of electrophotographic printing apparatus can be desirable in at least two scenarios. Firstly, cleaning is required to remove sludge (the agglomeration of discharged ink particles) from components of the apparatus to ensure that the apparatus functions adequately. Secondly, cleaning of components of the apparatus is desirable when one ink colour used by the apparatus is to be replaced with another ink colour.

In one aspect of the invention, there is provided an electrophotographic printing apparatus comprising an image-forming member having a surface on which a latent electrostatic image can be formed, a developer for depositing onto the surface of the image-forming member a layer of ink, the ink comprising charged particles and a carrier medium, an ink tank arranged to supply ink to the developer and receive unused ink from the developer and a separator for separating charged particles from the carrier medium, the separator connectable to the developer to receive unused ink from the developer and to reintroduce carrier medium extracted by the separator from the unused ink to the developer.

An embodiment of the invention will now be described, by example only, with reference to the accompanying drawings, in which:—

Figure 1:
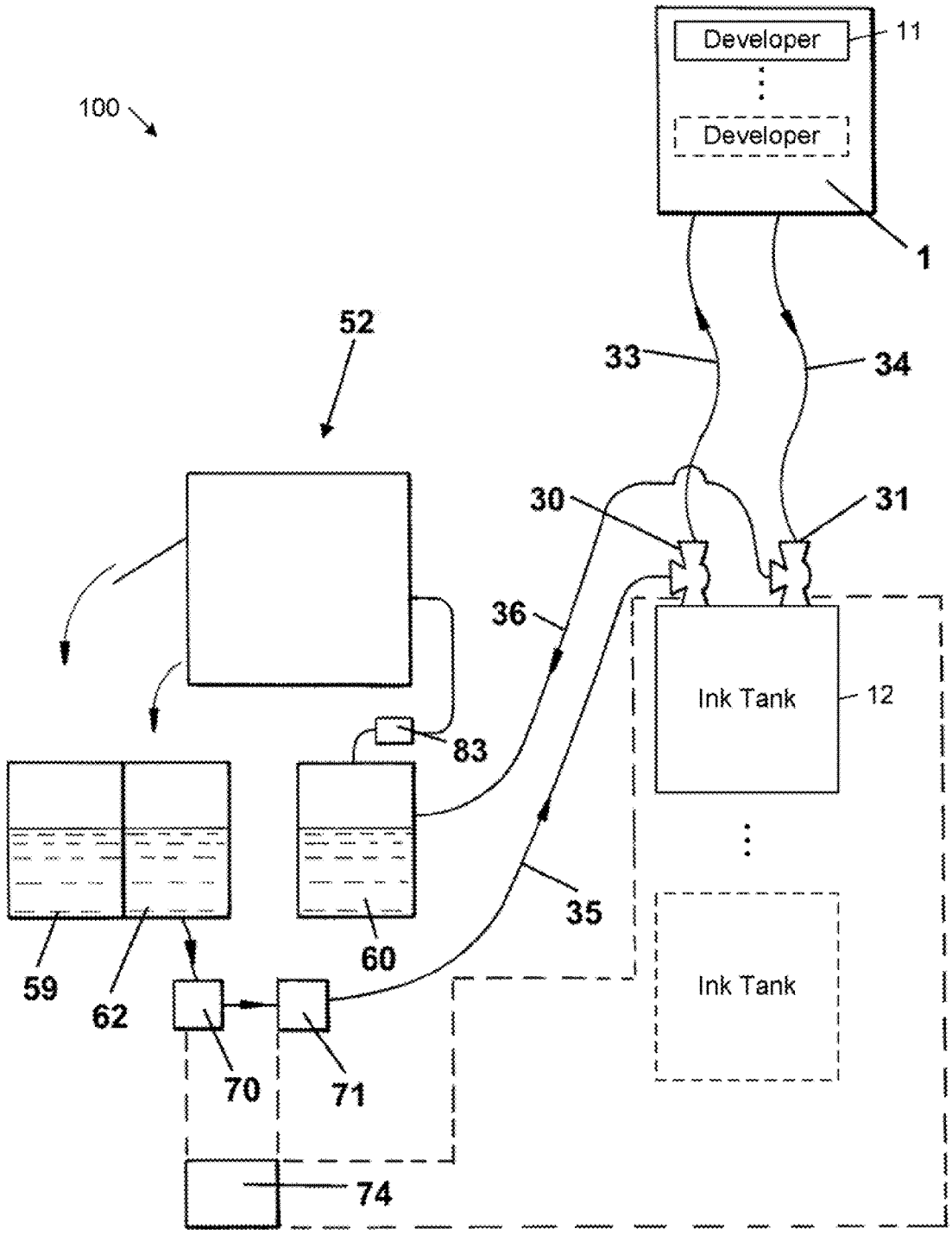
FIG. 1 is a schematic view of one embodiment of an electrophotographic printing apparatus in accordance with the invention.

Referring to the Figures, electrophotographic printing apparatus 100 comprises an image-forming device 1 for printing an image onto a substrate, such as paper, that is connectable to an ink tank 12 via a supply conduit 33 and an exit conduit 34. The ink used in the apparatus comprises charged ink particles carried in a carrier medium, for example polymeric multi-tentacled ink particles and a liquid carrier medium, for instance an isolefin such as ISOPAR. Typically about 2% of the ink by weight is ink particles.

The printing apparatus 100 further comprises a separator 52 connected to valves 30 and 31 by conduits 35 and 36 respectively such that the separator 52 can be selectively connected to the exit conduit 34 to receive ink and selectively connected to the supply conduit 33 to reintroduce carrier liquid extracted from the ink to the image-forming device 1 and conduits 33 and 34 (as explained in more detail below).

Figure 2:
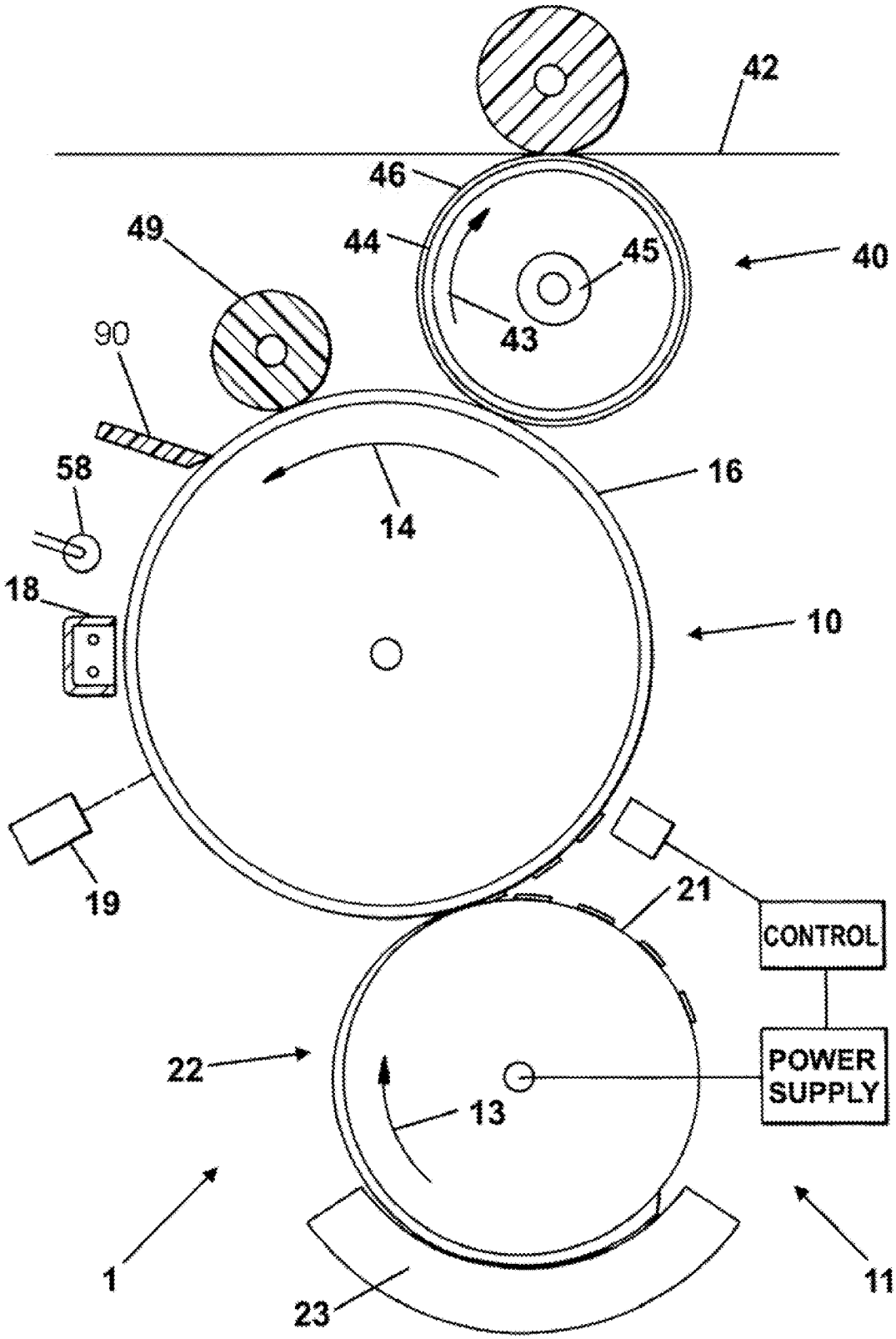
FIG. 2 (Prior Art)
FIG. 2 is a schematic view of the apparatus of FIG. 1 showing the developer and image-forming drum in more detail.
Figure 3:
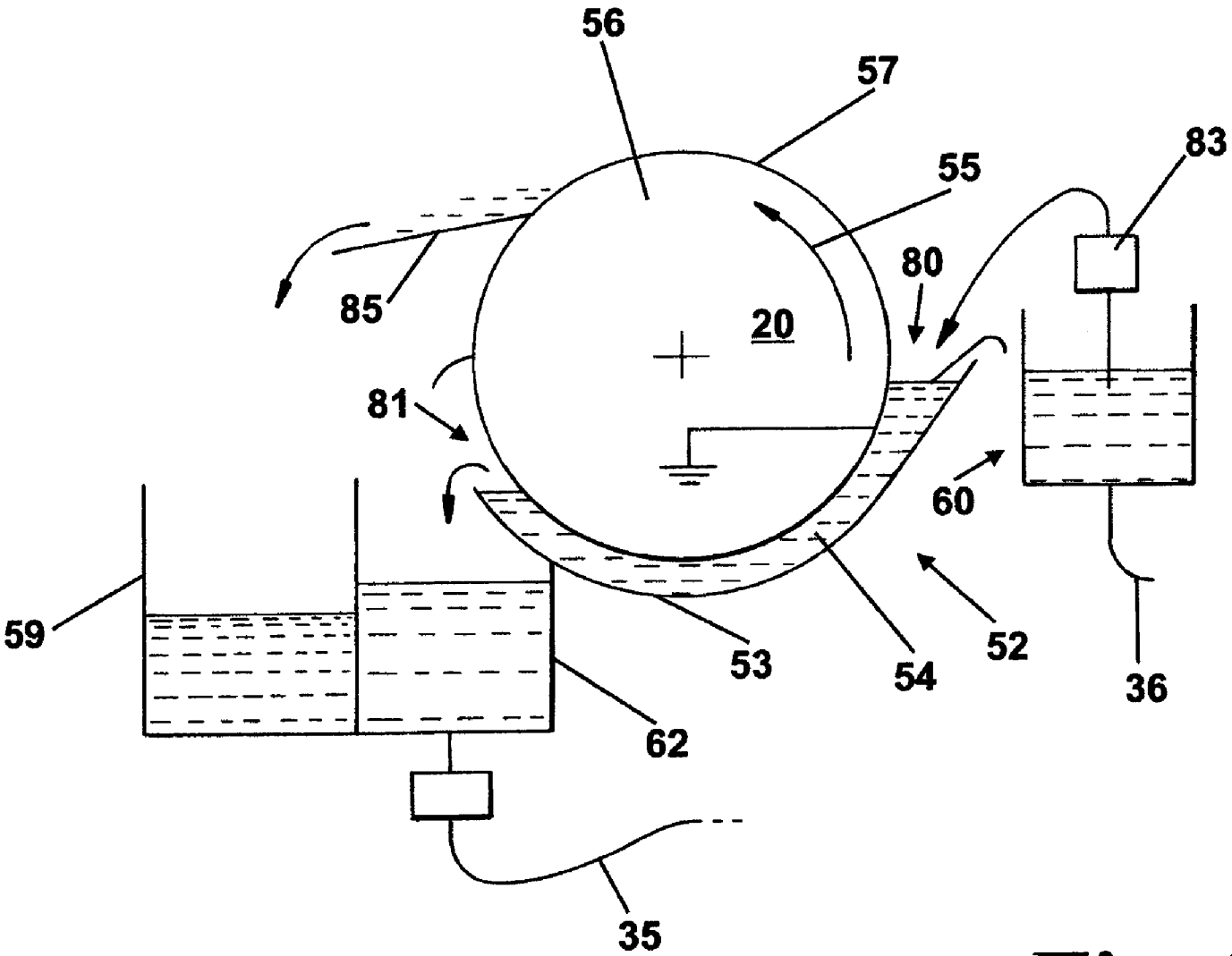
FIG. 3 is a schematic view of the separator shown in FIG. 1

Now referring to FIG. 2, the image-forming device 1 comprises an INDIGO-type BID (Binary Image Developer) having an image-forming member in the form of a drum 10 and a developer 11 for depositing onto a surface 16 of the drum 10 a layer of ink. The surface 16 is, in this example, a photoreceptor surface made of selenium, a selenium compound, an organic photoconductor or any other suitable photoconductor known in the art on which a latent electrostatic image can be formed.

During operation, drum 10 rotates, in this embodiment in an anticlockwise direction, indicated by arrow 14, and a charger 18 charges photoreceptor surface 16 to a predetermined voltage, typically of the order of 1000 volts. Charger 18 may be any type of charger known in the art, such as a corotron, a scorotron or a roller.

Continued rotation of drum 10 brings the charged photoreceptor surface 16 into alignment with an exposure device, for example a light source 19, such that the charged photoreceptor surface 16 is exposed to light emitted by the exposure device. The light source 19 may be a laser scanner (in the case of a printer) or the projection of an original (in the case of a photocopier). Light source 19 forms a desired latent image on the charged photoreceptor surface 16, by selectively discharging a portion of the photoreceptor surface 16, image portions being at a first voltage and background portions adjacent the image portions at a second voltage. The discharged portions preferably have a voltage of less than about 100 volts.

Continued rotation of drum 10 brings the selectively charged photoreceptor surface 16 into engagement with a surface 21 of a developer roller 22 of developer 11. Developer roller 22 rotates in an opposite direction to that of drum 10, in this embodiment, clockwise as shown by arrow 13, and at an angular velocity such that there is substantially zero relative motion between their respective surfaces at the point of engagement. Developer roller 22 is most preferably urged against drum 10.

An applicator assembly 23 of developer 11 coats surface 21 with a thin layer of ink. The applicator assembly 23 is supplied with ink from ink tank 12 via the supply conduit 33.

When surface 21 bearing the layer of ink engages with photoreceptor surface 16 of drum 10, the difference in potential between developer roller 22 and surface 16 causes selective transfer of the layer of ink particles to surface 16, thereby developing the latent image. Depending on the choice of ink charge polarity and the use of a "write-white" or "write-black" system, as known in the art, the layer of ink particles will be selectively attracted to either the charged or discharged areas of surface 16, and the remaining portions of the ink layer will continue to adhere to surface 21.

The applicator assembly 23 also removes unused ink (ink that has not been transferred to surface 16 of drum 10) from the developer roller 22. This applicator assembly 23 may be in accordance with those described in U.S. Pat. No. 5,610,694 or U.S. Pat. No. 5,596,396, the contents of which are hereby incorporated by reference. The unused ink removed by assembly 23 is delivered to exit conduit 34.

Accordingly, the supply conduit 33, developer 11 and exit conduit 34 form a flow path for ink that is connectable to the ink tank 12 such that ink can be cycled around the flow path and the ink tank 12 with ink that is not used by the image-forming device 1 being passed back to the ink tank 12 via exit conduit 34.

The latent image formed on the drum 10 may be directly transferred to a desired substrate from the image forming surface 16 in a manner well known in the art. Alternatively, as shown in FIG. 1, there may be provided an intermediate transfer member 40, which may be a drum 46 or belt and which is in operative engagement with photoreceptor surface 16 of drum 10 bearing the developed image. Intermediate transfer member 40 rotates in a direction opposite to that of photoreceptor surface 16, as shown by arrow 43, providing substantially zero relative motion between their respective surfaces at the point of image transfer.

Intermediate transfer member 40 is operative for receiving the ink image from photoreceptor surface 16 and for transferring the ink image to a final substrate 42, such as paper. Disposed internally of intermediate transfer member 40, there may be provided a heater 45 to heat intermediate transfer member 40. Transfer of the image to intermediate transfer member 40 is preferably aided by providing electrification of intermediate transfer member 40 to provide an electric field between intermediate transfer member 40 and the image areas of photoreceptor surface 16. Intermediate transfer member 40 preferably has a conducting layer 44 underlying an elastomer layer 46, which is preferably a slightly conductive resilient polymeric layer.

Following the transfer of the ink image to substrate 42 or to intermediate transfer member 40, the rotating photoreceptor surface 16 encounters and engages a cleaning station 49 which cleans most or substantially all ink, ink particles, carrier liquid remaining on the surface 16. The cleaning station may be any conventional cleaning station. In this embodiment, a scraper 90 completes the removal of any residual ink, ink particles, carrier liquid, which may not have been removed by cleaning station 49. A lamp 58 then completes a printing cycle of the drum 10 by removing any residual charge, characteristic of the previous image, from photoreceptor surface 16.

In this embodiment, the apparatus has been described with reference to a single developer 11 and ink tank 12, however it will be understood that the apparatus could comprise multiple ink tanks and developers, for example one for each colour to be printed (as indicated by the dashed "developer" and "ink tank" boxes in FIG. 1). In one example, for colour printing, the apparatus comprises at least four ink tanks and four developers containing the black, cyan, magenta and yellow ink. However, the apparatus may comprise fewer ink tanks and developers than this, such as for black and white printing, when only one ink colour is required. Alternatively, the apparatus may comprise additional ink tanks, such as ink tanks for special ink colours, e.g. luminescent colours.

The apparatus may also comprise an additional developer having external connections for connecting the additional developer to an ink tank external to the apparatus. This may have particular benefits when cleaning the apparatus as explained in more detail below.

During printing operations, the unused ink returned via conduit 34 to the ink tank 12 has a lower concentration of ink particles to carrier liquid and a lower volume than the ink supplied to the developer 1 via conduit 33. In a typical apparatus, the ink flow through supply conduit 33 is 8 L/min at a concentration of 2% by weight of ink particles, whereas the ink flow though the exit conduit 34 is 7.8 L/min with a concentration of about 1.7% by weight on ink particles, although the exact values will depend on the area to be printed. In order to maintain the required ink particle concentration and flow rate, separate sources (not shown) of ink particles and carrier liquid have to be provided to "top-up" the ink tank 12. Usually, these sources comprise a source of carrier liquid and a source of ink (ink particles and carrier liquid) having a high concentration of ink particles, typically 20% by weight.

During use ink particles and other ink residues can agglomerate in the components of the apparatus. Over time these can build up to such a degree as to cause deterioration of the operation of the apparatus, for example by obstructing the supply and exit conduits 33 and 34. Accordingly, it is desirable regularly to clean the apparatus to remove these residues. It is also desirable to clean the apparatus when the ink tank 12 is replaced, for example when it is replaced with an ink tank containing an ink of a different colour.

Cleaning of the apparatus can be carried out using the separator 52 which separates ink particles from the carrier liquid. The separator is selectively connectable to the flow path by valves 30 and 31 under the control of a controller 74. It will be understood that, if there is more than one developers the valves 30 and 31 may be arranged to connect the separator 52 to the supply and exit conduits of any one of the developers of the apparatus as and when cleaning of the flow path of that developer and supply and exit conduits is required. Normally, the flow path of each developer is connected sequentially to the separator in order to avoid mixing of colours.

The separator 502 is an electrostatic separator that comprises a curved conductive electrode 53 and a roller 56 that rotates, in this embodiment in an anticlockwise direction as indicated by arrow 55. The electrode 53 is shaped to follow the curvature of the developer drum 22 so as form a channel 54 therebetween having an inlet 80 for receiving unused ink and an outlet 81 for dispensing "cleaned" carrier liquid from the channel 54. The electrode 53 can be connected to a voltage supply to form an electrostatic charge on the electrode 53 that generates a static electric field across the channel 54.

The apparatus 100 also comprises a tank 60 forming a reservoir for receiving ink via conduit 36. A pump 83 pumps the ink in reservoir 60 into the channel 54 via inlet 80. As ink flows through the channel 54, it passes through the electric field generated by electrode 53, which causes charged ink particles in the unused ink to adhere to an earthed metal surface 57 of the roller 56 that is aligned with the electrode 53. The carrier liquid, in this case ISOPAR, is not charged and therefore, does not adhere to the surface 57 of the roller 56. Accordingly, ink particles are separated from the carrier liquid by the electrode 53 and roller 56.

Rotation of the roller 56 brings surface 57 (to which ink particles have adhered) into contact with a blade 85. Blade 85 scrapes ink particles that have adhered to the surface 57 from the surface 57 and dispenses these ink particles into a container 59. After one or more cleaning operations of the separator the ink particles recovered into container 59 can be removed from the apparatus for emptying (e.g. manually removed) and, in some cases, recycled as the ink particles can be expensive. Further rotation of the roller 56 brings the surface 57 cleaned of ink particles back into register with the electrode 53.

The carrier liquid from which ink particles (not necessarily all ink particles) have been removed is dispensed from outlet 81 of channel 54 into tank 62, which forms a reservoir for "clean" carrier liquid extracted from the unused ink by the separator 52.

This cleaned carrier liquid in reservoir 62 can then be returned to the developer 11 via conduit 35, valve 30 and conduit 33. The reservoir 62 of clean carrier liquid provides a buffer between the separator 52 and developer 11 so that the rate of flow of carrier liquid to the developer can be varied independently of the rate of flow of clean carrier liquid generated by the separator 52. In this regard, a pump 70 is provided in conduit 35 to control the flow of clean carrier liquid from the reservoir 62. The conduit 35 may also comprise a means for controlling the temperature of the clean carrier liquid, in this embodiment, an electrical heater 71.

The controller 74 controls the pump 70 and heater 71. To clean thoroughly the developer 11 and supply and exit conduits 33 and 34, the rate of flow of clean carrier liquid to the developer 11 may be set at the maximum allowed flow rate to maximize coverage of the components of the flow path by the carrier liquid as the carrier liquid flows through the developer 11 and conduits 33 and 34. In this respect, the controller 74 controls the pump 70 to vary the flow rate of the clean carrier liquid to suit different developers, as different developers may have different resistances to flow. In this embodiment, the controller 74 is pre-programmed with the required flow rate for each developer and uses an open loop method of control. The flow rates are determined by calibrating the apparatus beforehand. Recalibration of the apparatus may be required as the apparatus ages.

Controller 74 controls heater 71 to increase the temperature of the clean carrier liquid to a temperature that facilitates the dissolving of ink particles into the carrier liquid. In some embodiments, the temperature is between 30° C. and 55° C. and preferably between 40° C. and 55° C. It is desirable to increase the temperature to facilitate dissolving of the ink particles in the carrier liquid but the temperature is limited by the tendency of ISOPAR to burn up above certain temperatures.

When cleaning of the developer 11 and conduits 33 and 34 is desired, controller 74 causes valves 30 and 31 to switch the flow of ink to be between the flow path (developer 11 and conduits 33 and 34) and the separator 52 via conduits 35 and 36. In this state, unused ink collected by applicator assembly 23 is fed via exit conduit 34, valve 31 and conduit 36 to the reservoir 60 and cleaned carrier liquid is fed into the developer 11 via conduits 33 and 35. During a cleaning operation, the unused ink is cycled between the flow path and the separator 52 for a predetermined length of time. This time is selected to be, in this embodiment, the length of time that is deemed necessary for the majority, if not all, of the ink particles to be cleaned from the carrier liquids, the developer 11 and conduits 33 and 34. It will be understood that the cleaning operation is satisfactory if the liquid in the developer 11 and conduits 33 and 34 contains less then 0.001% by weight of ink particles.

During this cleaning cycle, another ink tank and developer can be used for depositing a required ink colour onto the image-forming drum 10. This process can be carried out manually or; alternatively, automatically when a cleaning operation is initiated.

In one embodiment, this is achieved by connecting a substitute ink tank containing the ink colour that is being cleaned to one of the external connections of the apparatus. This reduces interruptions in printing when carrying out a cleaning cycle. That is to say the printing apparatus 100 is capable of cleaning one or more flow paths whilst the printing apparatus 100 is still operational as a printer, and even whilst it is actually printing.

The apparatus may be arranged to carry out regular cleaning of the developers and the supply and exit conduits in order to prevent the build up of sludge in the apparatus. This regular cleaning could be carried out periodically for example daily, during periods when the apparatus is not printing, or after a predetermined number of printing operations. Alternatively or additionally, a sensor may monitor a parameter, such as resistance to the flow of ink, and instigate a cleaning operation in response to detection of that parameter reaching a predetermined threshold. Furthermore, a manual input device may be provided such that the operator of the apparatus 100 can initiate a cleaning operation.

The embodiment of the invention of FIG. 1 is advantageous as cleaning of the developer and supply and exit conduits can be carried out without having to remove these components from the apparatus, which can save downtime for the apparatus and the time and effort of an operator. Accordingly, cleaning of the developer and supply and exit conduits can be carried out automatically without or at least with less manual intervention or operations. This may allow cleaning of the apparatus to be carried out much more frequently than was the case previously. It is believed that frequent cleaning will produce a better print quality over the lifetime of the apparatus and extend the lifetime of the apparatus.

A further advantage of the embodiment described is that the electrostatic separator 52 does not require filters, which require regular replacement when they become blocked up.

Overall, it is expected that the costs of running and maintaining apparatus according to the invention will be less than the costs of maintaining current electrophotographic printing apparatus. Furthermore, the environmental impact of the machine will be reduced because the amount of waste carrier liquid (not normally environmentally friendly) is reduced, with the majority of the carrier liquid being recycled during a cleaning cycle.

It will be understood that the invention is not limited to the above-described embodiment, but includes modifications and alterations that fall within the scope of the invention as defined in the claims.

The developer 11 described comprises a developer roller 22, however it will be understood that other developers could be used that do not comprise developer rollers.

As well as connecting the separator 52 to the flow path (i.e. conduits 33 and 34 and developer 11), the valves may be operable to connect the separator 52 to the ink tank 12. In this way, the separator 52 could clean an ink tank 12 before the ink tank 12 is removed from the apparatus. This may further reduce the amount of waste material generated by the apparatus as more carrier liquid is recovered from the ink tank 12.

Furthermore, cleaning of the ink tank 12 by the apparatus may obviate the need for the operator to perform a separate cleaning operation on the ink tank 12 before reuse.

In the embodiment described, the separator 52 is an electrostatic separator however it will be understood that other types of separators could be used, in particular separators that use non-static electric fields to separate the ink particles from the carrier liquid.

Furthermore, the ink tank(s) may or may not form part of the electrophotographic printing apparatus. For example, the ink tank(s) 12 may be a removable component of the apparatus 100 that is fitted within the apparatus or alternatively, the apparatus 100 could have external connections for connecting to ink tanks 12 external to the apparatus 100. In the above-described embodiment, the separator 52 is connectable to the ends of the supply and exit conduits 33 and 34 of the flow path connected with the ink tank 12. This allows the flow of ink to the ink tank 12 to be interrupted during a cleaning operation such that the ink tank 12 can be removed for replacement during cleaning of the flow path and allows the flow path and ink tank 12 to be cleaned in separate cleaning operations. However, it will be understood that in other embodiments, the separator 52 is connectable to the flow path at other points along the flow path. This may prevent the flow of ink to the ink tank 12 being interrupted during a cleaning operation and require cleaning of the flow path (developer 11 and conduits 33 and 34) together with the ink tank 12, for example if both conduits 35 and 36 are connectable to the flow path via exit conduit 34.

In one embodiment, the apparatus 100 is arranged to automatically transfer ink particles from container 59 to an ink particle tank. Ink particles from the ink particle tank can then be reintroduced to the ink tank 12 as and when required, for example, when the concentration of ink particles to carrier liquid in ink tank 12 drops below a predetermined amount.

The invention claimed is:

1. An electrophotographic printing apparatus, comprising:

an image forming member having a surface on which a latent electrostatic image can be formed;

a developer operable to deposit onto the surface of the image-forming member a layer of ink, the ink comprising charged ink particles and a carrier medium;

a supply conduit connecting an ink tank to the developer and an exit conduit connecting the ink tank to the developer, wherein ink is supplied from the developer to the ink tank through the exit conduit, and the supply conduit, the developer, and the exit conduit define a flow patch between the developer and the ink tank; and a separator connectable to the flow path to receive from the flow path unused ink supplied from the developer, operable to extract the carrier medium from the unused ink received from the flow path, and connectable to the flow path to supply the extracted carrier medium to the flow path;

wherein the separator comprises an electrode and a blade, the electrode being electrically chargeable to generate an electric field the causes separation of the charged ink particles from the carrier medium in the unused ink received from the flow path by attracting the charged ink particles to a surface, and the blade being operable to remove charged ink particles that are attracted to the surface from the surface.

2. Apparatus according to claim 1, wherein the separator is connectable to the exit conduit to receive unused ink from the developer and connectable to the supply conduit to reintroduce carrier medium extracted from the unused ink to the developer.

3. Apparatus according to claim 2, wherein the supply conduit and the exit conduit have valves that are operable to switch the flow of ink between being (i) between the ink tank and the developer to being (ii) between the separator and the developer.

4. Apparatus according to claim 3, wherein the valves are operable to switch the flow of ink to be between the ink tank and the separator.

5. Apparatus according to claim 3, wherein the valves are located, at the ends of the supply conduit and exit conduit that are connectable to the ink tank.

6. Apparatus according to claim 1, further comprising: a carrier medium reservoir that is adapted to receive the extracted carrier medium from the separator; and a second flow path that is adapted to carry the extracted carrier medium from the carrier medium reservoir to the flow path.

7. Apparatus according to claim 6, further comprising: a pump that is coupled to the second flow path and is operable to pump the extracted carrier medium from the carrier medium reservoir to the flow path; and a controller adapted to cause the pump to vary a flow rate of the extracted carrier medium pumped from the carrier medium reservoir.

8. Apparatus according to claim 1, further comprising a heater adapted to heat and control the temperature of the extracted carrier medium that is supplied from the separator to the flow path.

9. Apparatus according to claim 1, comprising a plurality of developers, each developer for depositing onto a surface of the image-forming member as layer of ink and connected with a supply conduit and an exit conduit to define a flow path, wherein the separator is selectively connectable to any one of the flow paths.

10. Apparatus according to claim 9, wherein the plurality of developers are arranged such that, during connection of the separator to a flow path associated with one of the developers of the plurality of developers, the other developers of the plurality of developers are capable of depositing ink onto the surface of the image-forming member.

11. A method of operating an electrophotographic printing apparatus, the method comprising:

depositing ink from a developer onto the surface of an image-forming member, the ink comprising charged ink particles and a carrier medium;

supplying ink from an ink tank, through a supply conduit, to the developer;

supplying unused ink from the developer, through an exit conduit, to the ink tank, wherein the supply conduit, developer and exit conduit define a flow path between the developer and the ink tank;

delivering unused ink supplied from the developer from the flow path to a separator;

the separator extracting the carrier medium from the unused ink received from the flow path;

wherein extracting the carrier medium from the unused ink received from the flow path comprises charging an electrode to generate an electric field that causes separation of the charged ink particles from the carrier medium in the unused ink received from the flow path by attracting the charged ink particles to a surface, and by a blade removing charged ink particles that are attracted to the surface from the surface; and supplying the extracted carrier medium to the flow path.

12. A method according to claim 11, comprising disconnecting the ink tank from the flow path, delivering unused ink from the developer to the separator, and cleaning the flow path and the developer, wherein the cleaning comprises supplying carrier medium extracted from the unused ink to the developer through the supply conduit.

13. A method according to claim 12, comprising delivering unused ink from the ink tank to the separator, and supplying carrier medium extracted from the unused ink to the ink tank.

14. A method according to claim 12, comprising, after the cleaning has been carried out, reconnecting the flow path to the ink tank.

15. A method according to claim 12 or claim 13, comprising, after the cleaning has been carried out, connecting a different ink tank containing a different colour of ink to the flow path.

16. A method according to claim 11, further comprising varying the rate of flow of the extracted carrier medium from the separator to the flow path.

17. A method according to claim 11, further comprising controlling the temperature of the extracted carrier medium that is supplied to the flow path from the separator.

18. A method according to claim 11, wherein the apparatus comprises a plurality of developers, each developer for depositing onto a surface of the image-forming member a layer of ink and connected with a supply conduit and an exit conduit to define a flow path, wherein the separator is selectively connectable to each one of the flow paths, the method comprising connecting the separator to one of the flow paths to clean that flow path while another of the plurality of developers deposits a layer of ink onto the image-forming member.

* * * * *

UNITED STATES PATENT AND TRADEMARK OFFICE

CERTIFICATE OF CORRECTION

PATENT NO. : 7,756,449 B2
APPLICATION NO. : 11/829746
DATED : July 13, 2010
INVENTOR(S) : Haim Belinkov et al.

It is certified that error appears in the above-identified patent and that said Letters Patent is hereby corrected as shown below:

In column 7, line 8, in Claim 1, delete "patch" and insert -- path --, therefor.

In column 7, line 38, in Claim 5, delete "located," and insert -- located --, therefor.

In column 7, line 57, in Claim 9, delete "as" and insert -- a --, therefor.

Signed and Sealed this

Thirtieth Day of November, 2010

David J. Kappos

David J. Kappos
*Director of the United States Patent and Trademark Office*